US011325811B2

(12) United States Patent
Kennedy et al.

(10) Patent No.: US 11,325,811 B2
(45) Date of Patent: May 10, 2022

(54) MINE SHAFT CONVEYANCE SAFETY BRAKE

(71) Applicant: FLSMIDTH A/S, Valby (DK)

(72) Inventors: Donald Todd Kennedy, Ontario (CA); Henry T. Laarakker, Ontario (CA); Marcus Thiesen, Ontario (CA)

(73) Assignee: FLSmidth A/S

( * ) Notice: Subject to any disclaimer, the term of this patent is extended or adjusted under 35 U.S.C. 154(b) by 90 days.

(21) Appl. No.: 16/500,951

(22) PCT Filed: Apr. 4, 2018

(86) PCT No.: PCT/EP2018/058544

§ 371 (c)(1),
(2) Date: Oct. 4, 2019

(87) PCT Pub. No.: WO2018/185127

PCT Pub. Date: Oct. 11, 2018

(65) Prior Publication Data

US 2021/0130129 A1 May 6, 2021

(30) Foreign Application Priority Data

Apr. 4, 2017 (DK) ..... PA 2017 70243

(51) Int. Cl.
*B66B 5/22* (2006.01)

(52) U.S. Cl.
CPC ..... *B66B 5/22* (2013.01)

(58) Field of Classification Search
CPC .... B66B 5/22; B66B 5/16; B66B 5/18; B66B 5/284; B66B 17/04; B66B 7/047
See application file for complete search history.

(56) References Cited

U.S. PATENT DOCUMENTS 255,041 A 3/1882 Sleeper
299,547 A 6/1884 Hutchinson
(Continued)

FOREIGN PATENT DOCUMENTS

JP 3114045 B2 * 12/2000 ..... F16D 63/008
WO WO-2012137248 A1 * 10/2012 ..... B66B 5/18

OTHER PUBLICATIONS

The International Search Report and Written Opinion dated Jul. 12, 2018, 13 pages.

*Primary Examiner* — Michael R Mansen
*Assistant Examiner* — Michelle M Lantrip
(74) *Attorney, Agent, or Firm* — Jeffrey A. Sharp

(57) ABSTRACT

The disclosure relates to a mine shaft conveyance safety brake for controlling the rate of deceleration of a free-falling conveyance, operating within or upon fixed shaft guides, in a vertical, substantially vertical or inclined mine shaft. The safety brake includes an activation system, one or more guide clamp assemblies operable for locking onto one or more shaft guides, one or more braking assemblies and one or more brake paths attached upon the conveyance. Upon detection of a conveyance suspension failure or slack rope condition associated with a free-falling or obstructed condition of the conveyance, the activation system is triggered, causing each guide clamp assembly to self-lock onto a shaft guide. Upon further downward travel of the conveyance, the braking assemblies travel upwardly upon the brake paths, generating increasing braking forces in a controlled manner until the conveyance comes to a controlled stop. The safety brake is purely mechanical in nature, as there are no electronics, electro-mechanical controls or hydraulic systems involved.

8 Claims, 7 Drawing Sheets

SAFETY BRAKE DEVICE

(56) References Cited

U.S. PATENT DOCUMENTS

| | | | | | |
|---|---|---|---|---|---|
| 820,637 | A | | 5/1906 | Gable et al. | |
| 2,150,373 | A | * | 3/1939 | Hymans | B66B 5/22 187/376 |
| 2,555,041 | A | * | 5/1951 | King | B66B 5/22 187/372 |
| 5,159,995 | A | * | 11/1992 | Sissala | B66B 5/22 187/376 |
| 5,363,942 | A | * | 11/1994 | Osada | B66B 5/22 187/376 |
| 5,370,208 | A | * | 12/1994 | De Jong | B66B 5/22 187/372 |
| 6,161,653 | A | * | 12/2000 | Skalski | B66B 5/04 187/305 |
| 6,997,287 | B2 | * | 2/2006 | Sasaki | B66B 5/22 187/376 |
| 9,878,877 | B2 | * | 1/2018 | Pursiainen | B66B 5/0075 |
| 2011/0303494 | A1 | * | 12/2011 | Studer | B66B 5/18 187/359 |
| 2014/0151159 | A1 | * | 6/2014 | Mizuno | B66B 5/18 187/359 |
| 2016/0325964 | A1 | * | 11/2016 | Haapaniemi | B66B 5/22 |

* cited by examiner

CONVEYANCE IN SHAFT
WITH STEEL GUIDES

CONVEYANCE WITH FLSMIDTH SAFETY BRAKE IN SHAFT WITH STEEL GUIDES

SAFETY BRAKE DEVICE (CONVEYANCE STRUCTURE MOSTLY HIDDEN FOR CLARITY)

FLSMIDTH SAFETY BRAKE SIDE VIEW

SAFETY BRAKE DEVICE SHOWING BRAKE CALIPER ASSEMBLIES LOCKING INTO TRIGGER PADDLE

EXPLODED VIEW OF BRAKE CALIPER ASSEMBLY

CLAMP AND FRICTION ASSEMBLY

MINE SHAFT CONVEYANCE SAFETY BRAKE

FIELD OF THE INVENTION

This application pertains generally to underground mine shaft conveyance systems, and more particularly, to a safety brake for controlling the rate of deceleration of a free-falling conveyance, operating within or upon fixed shaft guides, in a vertical, substantially vertical or inclined mine shaft having a substantial vertical component.

BACKGROUND OF THE INVENTION

In underground vertical, substantially vertical or inclined shaft mining operations, workers, materials (including equipment, tools and other mining materials), waste rock and ore are transported within the mine shaft between ground or other surface levels and an underground working area of the mine by conveyances suspended by a wire cable (wire rope). Workers and materials are transported into and out of the mine in conveyances generally referred to as cages. Waste rock and ore are transported out of the mine in conveyances which are also generally referred to as skips. Throughout this document reference to conveyances will refer to a conveyance intended to transport personnel whether a cage or skip/cage combination.

Conveyances are raised and lowered by attached cables (wire ropes) in a manner similar to cable-operated personnel elevators. A mine shaft can consist of several compartments each of which is a dedicated travel way for one conveyance. The conveyances are "guided" within the mine shaft compartments such that they remain within their respective compartments to avoid collision with other conveyances or other obstructions. The shaft guides can be of timber, steel, other similar hard material, or cable (wire rope) construction. Shaft guides of timber, steel, or other similar hard material are known as fixed guides. In the case of cages, the shaft guides are commonly to be of timber or steel construction, and are typically secured to the mine shaft wall in a substantially vertical configuration coincident with the configuration of the mine shaft.

Mine shafts using vertical, substantially vertical or inclined hoisting can typically be from two hundred to 3,000 meters or more deep within the ground. Therefore, in the event of a failure of the hoisting cable (wire rope) or its attachment to the conveyance, there is a critical need for a means of "catching" the conveyance to prevent it from falling uncontrollably to the bottom of the shaft. Such a fall would almost certainly result in significant physical harm to conveyance occupants and/or other personnel near the crash site at the bottom of the shaft, along with severe property and equipment damage. In addition, preventing serious injury of conveyance occupants during a "safety catch" event requires that the conveyance is decelerated at a rate safe enough for the human body to tolerate. A sudden stop of the conveyance is generally not tolerable and can result in serious injury or even death for the occupants. For this reason, some mining regulations have required that a "safety catch" device must safely decelerate the conveyance to a stop at a rate of not less than nine (9) meters per second per second and not more than twenty (20) meters per second per second in the event that it becomes detached from its means of suspension. Accordingly, the means for "catching" the conveyance must provide sufficient mechanisms to first detect the absence of conveyance suspension, deploy a means of emergency conveyance support and then to decelerate the conveyance in a controlled and/or modulated manner and bring it safely to a stop while minimizing risk of personnel injury. Such means must also be capable of activating without intentional delay time upon detection of a conveyance suspension failure condition.

To date, such mining regulations have meant that mine shaft guides would have to be made from timbers and that the "safety catches" would have to be what are commonly termed as "safety dogs". Safety dogs for use on timber mine shaft guides are heavy duty wood penetrating teeth arranged on a rotating shaft such that, when activated, the teeth are aggressively rotated into the timber. The teeth penetrate into the timber and the downward forces generated by the falling conveyance cause them to remain engaged and gouge a trough into the timber until sufficient energy is absorbed bringing the conveyance to rest while remaining suspended by the safety dogs. Such safety dog type mechanisms serve well to arrest free falling conveyances but their deceleration rate performance relates directly to the natural properties (grain, moisture content, knots, splits, checking, etc.) of the timber guides. Since the natural properties of timber guides are widely variable, actual experienced conveyance deceleration rates in a free-falling condition tend to be variable and unpredictable.

For reasons of economics and reliability, milling companies have a strong desire to make use of steel shaft guides, or guides constructed from other similar hard materials, when appropriate. To the inventors' knowledge, there are no tested and proven safety catch mechanisms available today for use with steel or similar hard material guides which are entirely mechanical and which meet regulations containing, among other requirements, the prescribed deceleration rates as those noted above. Some recently-developed mechanisms are complex electro-hydraulic-mechanical systems requiring electronic controls and are actuated by hydraulics. Such systems operate under entirely different and less predictable principles, especially in the dirty and difficult environment of a mine shaft, where a purely mechanical system would inherently tend to be more reliable. Other wedge type mechanisms, known as type "W" safety devices, are simple mechanical wedges that engage between the steel guides and the conveyance and provide no intentional regulation of deceleration, bringing free falling conveyances along steel guides in vertical mine shafts to an abrupt stop. However, those mechanisms do not include any means of managing deceleration rates in a predictable and controlled way, such that their engagement results in very aggressive or immediate conveyance arrestment, delivering forces beyond what the human body can tolerate. Accordingly, to the inventors' knowledge, neither the electro-mechanical hydraulically-actuated systems nor the wedge type systems have been developed on the principle of using engineered and purpose-built brake system elements to assure achievement of the regulated deceleration rates noted above.

Although safety brake mechanisms do exist in a number of other fields, they typically do not perform sufficiently well when applied to the mine shaft conveyance field. As an example, safety brake mechanisms for trains often use mechanical clamps that automatically engage rails to bring an otherwise uncontrolled train to a stop, but such clamps tend to not provide sufficient control or modulation of the braking or clamping force when applied to the mine shaft conveyance field, causing an undesirable stop of the conveyance. Safety brake mechanisms for passenger roller coasters at entertainment parks often use mechanical calipers that engage the underlying track to bring an otherwise uncontrolled roller coaster car to a controlled stop. Again, however, such mechanisms would tend to not provide sufficient control or modulation of the braking or clamping force when applied to a vertically-traveling conveyance in the mine shaft conveyance field.

Safety brake mechanisms in the commercial/business building passenger elevator field often utilize built-in spring energy which is released upon hoisting cable failure, which activates clamps on the steel elevator shaft guide rails. In that arrangement, slippage of the clamps relative to the guide rails is permitted, as the clamps typically do not grab with enough force to bring the elevator to an undesirable sudden stop. Although braking in the passenger elevator field takes place along the vertical travel path of the elevator along the guide rails, such elevators typically operate in a clean and controlled environment and travel at considerably slower speeds than mine shaft conveyances. Mine shaft conveyances typically carry much higher payloads than passenger elevators and operate in much harsher environments. Accordingly, the clamping mechanism of the type used in the passenger elevator field would be inappropriate to perform a controlled safe stop of a faster-traveling and heavier mine shaft conveyance.

Accordingly, there exists a need for a mine shaft conveyance safety brake for use with guides constructed of a suitable hard material, such as steel, that is suitable for handling the speed and weight of a mine shaft conveyance in a free-falling condition, that provides sufficient control over free fall distance and to decelerate it in a controlled and/or modulated manner and bring it safely to a stop while minimizing risk of injuring personnel being transported. Such means must be capable of activating quickly upon detection of a suspension failure condition, and preferably does not bring the conveyance to an abrupt stop. Such means should preferably exhibit characteristics and properties which include greater safety for personnel, adjustability to accommodate existing and future regulations with respect to prescribed deceleration rates and retrofitting potential to enable equipment upgrades. Such means should preferably also be purely mechanical and self-contained, be easy to maintain, be adjustable/scalable to suit each application and regulated requirement, achieve regulated deceleration rates regardless of load, enhance passenger safety and protect property and equipment. It would also be advantageous if such a system could be adapted for application to mine shaft conveyances guided along timber guides. The subject matter disclosed herein at least partially satisfies this need.

SUMMARY OF THE INVENTION

It is, in general, an object of the invention to provide a new and improved mine shaft conveyance safety brake for use with steel or similar guides that overcomes the limitations and disadvantages of the prior art. These and other objects are achieved in accordance with the invention by providing a mine shaft conveyance safety brake for controlling the rate of deceleration of a free-falling conveyance operating upon shaft guides fixed within a mine shaft having a substantial vertical component. The safety brake comprises an activation system operable for supporting the conveyance during normal travel of the conveyance upon the shaft guides and storing activation energy while supporting the conveyance. The activation system is also operable for detecting a conveyance suspension failure or slack rope condition associated with a free-falling or obstructed condition of the conveyance, and is further operable for releasing the stored activation energy upon detecting a conveyance suspension failure or slack rope condition to activate the safety brake.

The safety brake further comprises at least one guide clamp assembly disposed in communication with said activation system and operable to substantially self-lock onto a shaft guide upon activation by the activation system; at least one brake path fixedly attached upon the conveyance; and at least one braking assembly disposed in communication with at least one guide clamp assembly and disposed for traveling engagement with at least one brake path. Release of the stored activation energy by the activation system causes each guide clamp assembly to be released from a standby condition and to substantially self-lock onto a shaft guide, causing each braking assembly to travel upwardly upon said at least one brake path as the conveyance falls downwardly. Upward travel of each braking assembly upon each brake path generates increasing braking forces by each braking assembly upon each brake path in a controlled manner, thereby bringing the conveyance to a stop.

DETAILED DESCRIPTION

In accordance with the present invention, a mine shaft conveyance safety brake for use with steel or similar brake guides is provided that is capable of handling the speed and weight of a mine shaft conveyance in a free-falling condition. For purposes of this description, steel guides will be used as an example. The safety brake is purely mechanical and self-contained and provides sufficient control over the downward travel free fall distance of the conveyance and to decelerate it in a controlled and/or modulated manner and bring it safely to a stop while minimizing risk of injuring personnel being transported. The safety brake is further capable of activating quickly upon detection of a conveyance suspension failure condition and does not bring the conveyance to an abrupt stop. Its main components include an activation system rooted in a time proven "safety dog"

style operating mechanism, a clamping mechanism designed to "lock" onto steel or similar shaft guides, mechanical brake calipers and specially engineered brake paths. The activation system consists of a draw bar assembly that, when carrying the weight of the conveyance, compresses springs for the purpose of storing activation energy. When the draw bar no longer supports the weight of the conveyance, the stored energy in the springs forces it downward relative to the conveyance draw head. Linkage connected to the draw bar then activates the safety device, whether that be a safety dog style device or the present invention. There are no electronics, electro-mechanical controls or hydraulic systems involved.

Figure 1:
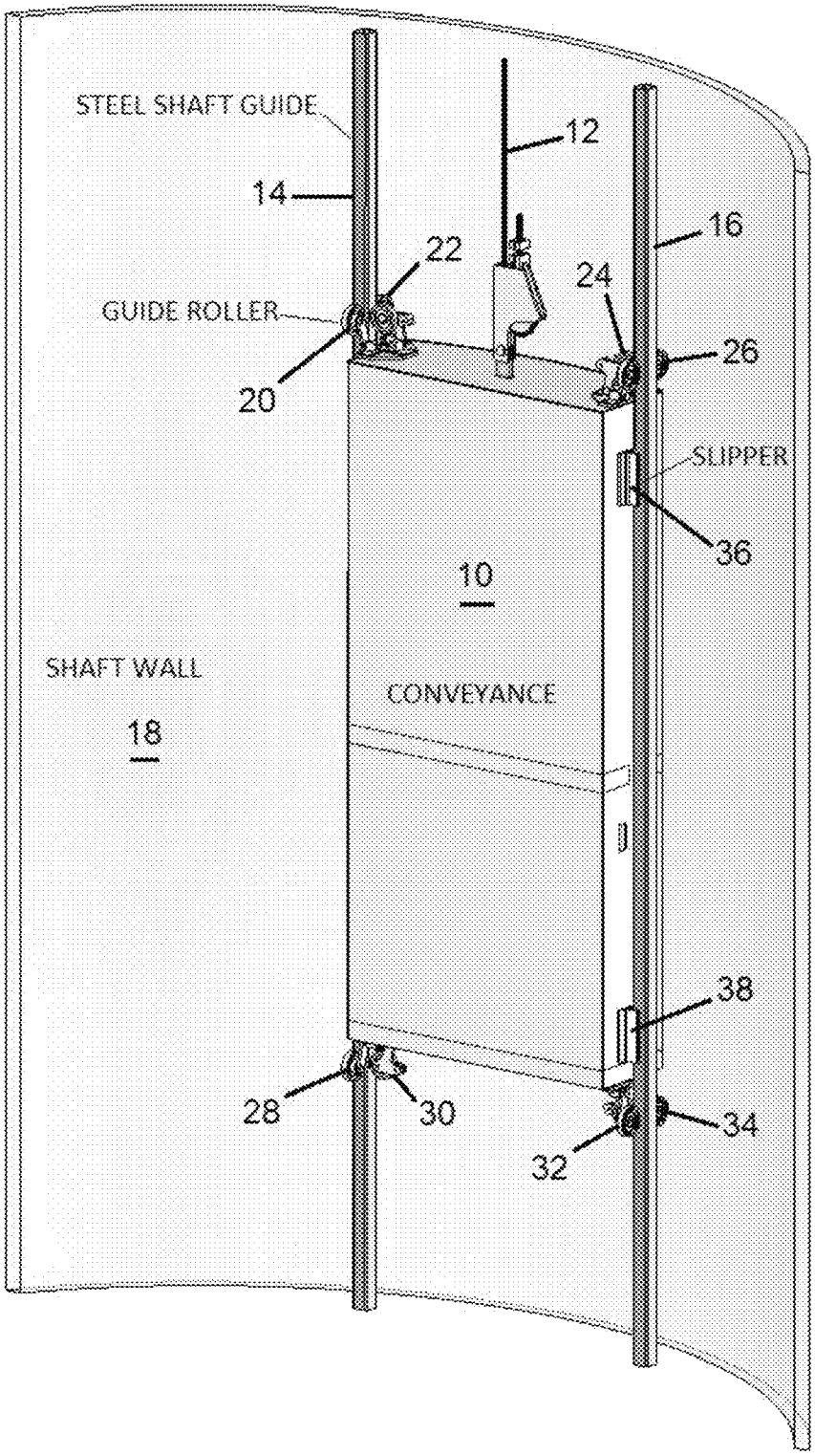
FIG. 1 is a perspective view of a mine shaft conveyance traveling along steel guides disposed in fixed relation to a wall of a mine shaft.

As shown in FIG. 1, a conveyance 10 is suspended by a hoisting cable (wire rope) 12, and travels vertically along a pair of generally parallel guides 14 and 16 made from steel or similar hard material that are disposed in fixed relation to a mine shaft wall 18 by fastening means (not shown) well known to those skilled in the art. The guides 14 and 16 are disposed substantially parallel to the mine shaft wall 18, which, depending on the inclination of the mine shaft, may be in a substantially vertical configuration. The hoisting cable (wire rope) 12 terminates onto a conventional drawbar (not numbered in FIG. 1) of the type well known in the art. The conveyance 10 is guided in its vertical travel along the guides 14 and 16, and is kept centered relative to the guides 14 and 16, by a plurality of guide rollers shown at 20, 22, 24, 26, 28, 30, 32 and 34, disposed in upper opposed pairs and lower opposed pairs and secured to the conveyance 10, which engage the surfaces of the guides 14 and 16. A plurality of slippers for further guiding the conveyance 10 in its vertical travel and keeping the conveyance 10 centered relative to the guide rails 14 and 16 are also disposed in upper opposed pairs and lower opposed pairs and secured to the conveyance 10, two of which are visible in FIG. 1 at 36 and 38. In practice, the slippers, such as those shown at 36 and 38, seldom contact the guides 14 and 16 if the guide rollers 20, 22, 24, 26, 28, 30, 32 and 34 are secured properly, aligned properly and operating properly.

Generally, mine shaft conveyances can include one or more levels, depending on the amount of personnel and materials to be transported. The conveyance 10 shown in FIG. 1 has two levels, although it will be appreciated that the present invention is intended to apply to any configuration of personnel carrying mine shaft conveyance.

Figure 2:
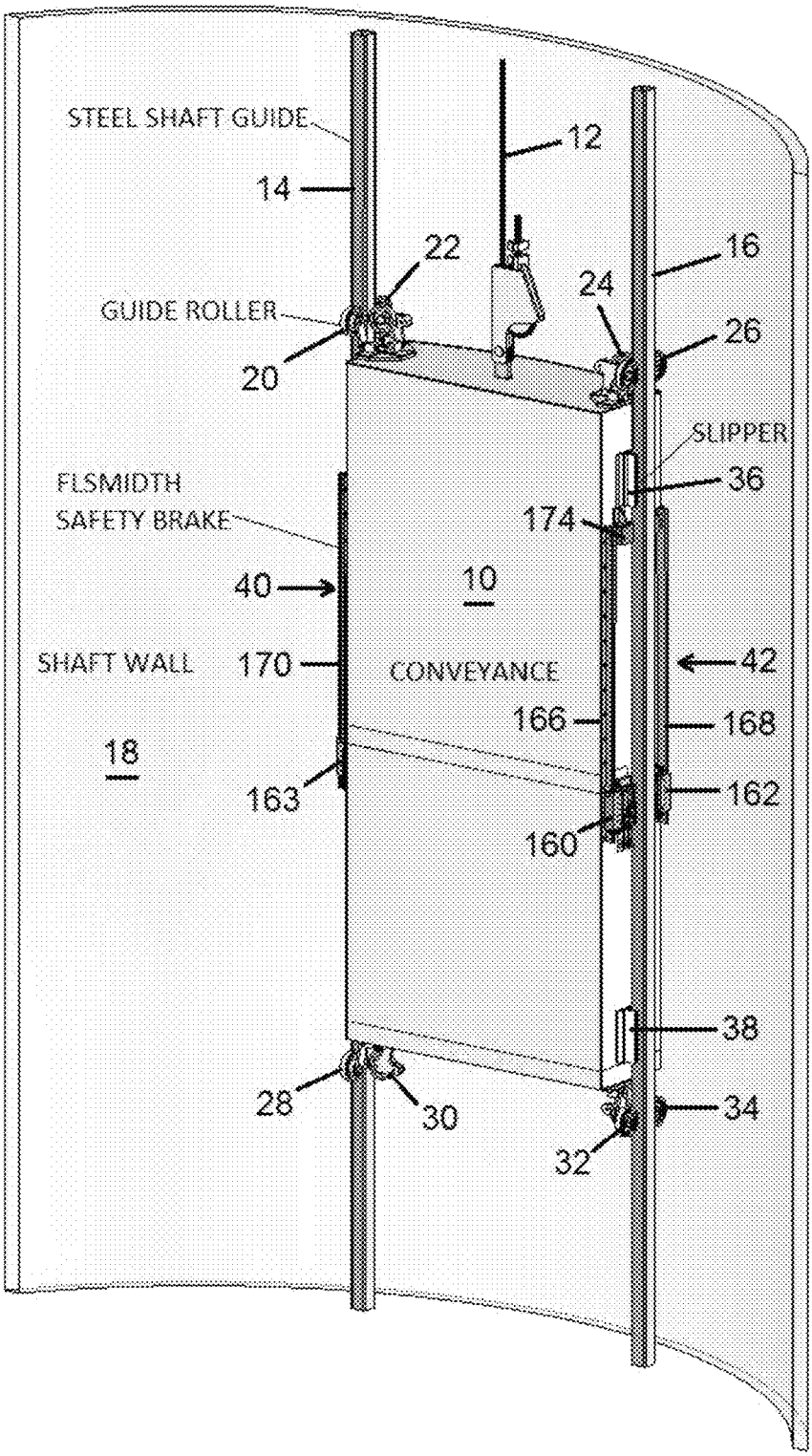
FIG. 2 is a perspective view of a mine shaft conveyance traveling along steel guides disposed in fixed relation to a wall of a mine shaft, along with the safety brake of the present invention.

FIG. 2 shows the same conveyance arrangement as shown in FIG. 1, wherein the same reference numerals have been maintained for consistency. However, FIG. 2 also shows a safety brake according to the present invention, provided in two substantially identical assemblies at 40 and 42, secured upon opposite sides of the conveyance 10 in close proximity for engagement with the guides 14 and 16.

Figure 3:
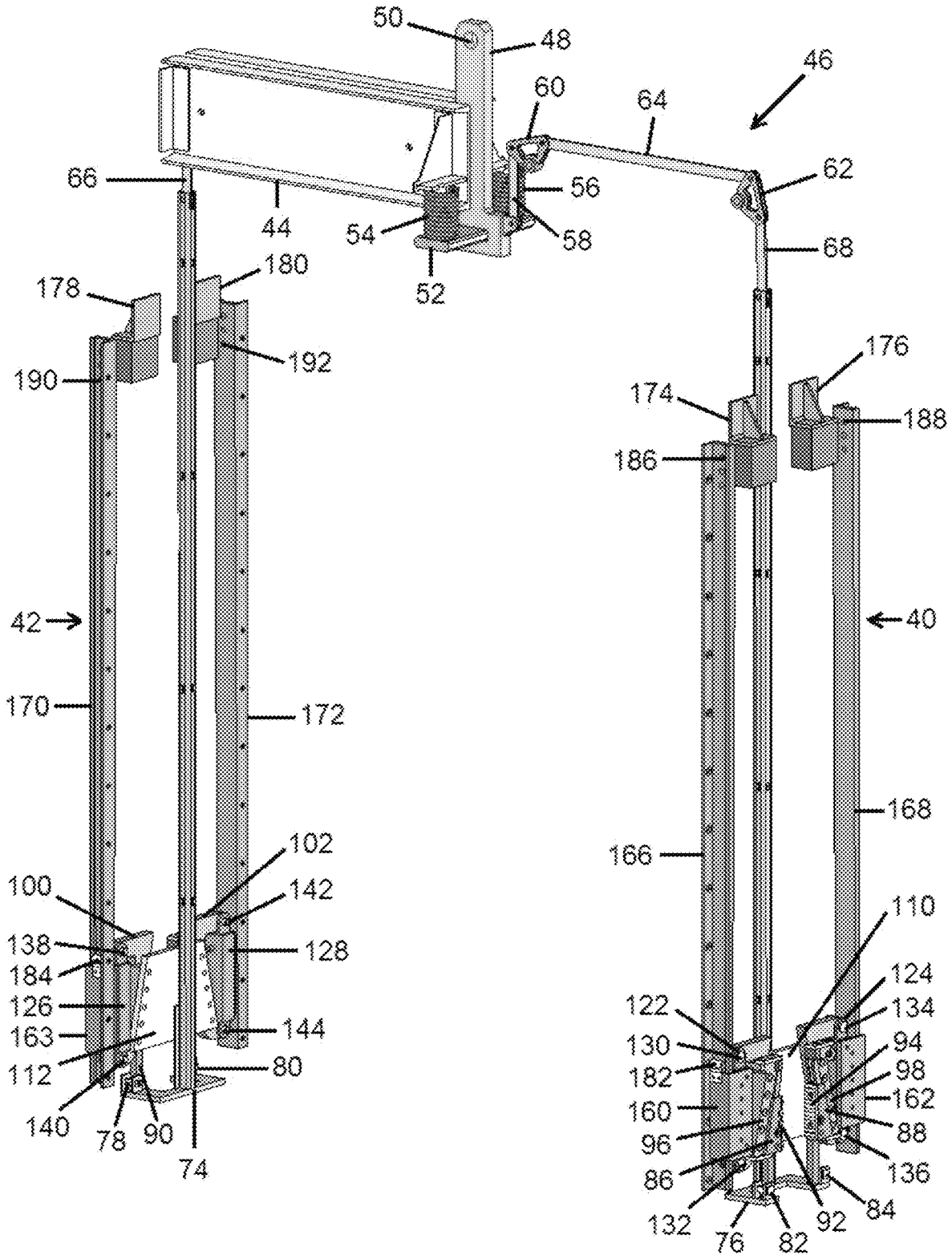
FIG. 3 is a perspective view of a safety brake and associated activation linkage system of the type associated with a mine shaft conveyance, in accordance with the present invention.

FIG. 3 shows the entire structure of the safety brake 40 and 42 in greater detail, but with most of the structure of the conveyance 10 omitted, for ease of viewing the safety brake components. Accordingly, FIG. 3 shows the safety brake assemblies 40 and 42 in the configuration and orientation that they would be in if attached to opposing sides of the conveyance 10. FIG. 3 also shows a cutaway half-portion of a drawhead structure 44, which forms an upper part of the conveyance 10 and suspends the conveyance through its connection to the hoisting cable (wire rope) 12 (not shown in FIG. 3) as described below. The drawhead structure 44 ordinarily extends across the full upper portion of the conveyance, but is only shown in part in FIG. 3 to allow other components to be viewed.

As also shown in FIG. 3, the conveyance is suspended (through its connection to the hoisting cable (wire rope)) by a traditional, time-proven rope attachment system (not shown) secured to a drawbar 48 at aperture 50. A safety brake activation system (also known as a trigger linkage system) 46 employs a sprung linkage between the drawbar 48 and the drawhead 44. The drawbar 48 transfers the cable (wire rope) end load from the conveyance upper drawhead structure 44 to the hoisting cable (wire rope). The drawbar system 48 includes a cross plate 52 and a pair of trigger springs 54 and 56. The cross plate 52 provides a structural connection between the trigger springs 54 and 56 and the drawbar 48. Because of their positions between the cross plate 52 (which is pulled upwardly by its attachment to the drawbar 48 during suspension of the conveyance by the hoisting cable (wire rope)) and the upper drawhead structure 44, the trigger springs 54 and 56 are maintained in a compressed condition during normal raising and lowering operations of the conveyance. Accordingly, as long as the hoisting cable (wire rope) is attached to the draw bar 48, the weight of the conveyance alone compresses the trigger springs 54 and 56, thereby storing energy in the trigger springs 54 and 56.

The remaining components of the trigger linkage system 46 include a pair of drawbar links (only one of which is shown at 58 in FIG. 3), which are pivotally attached to opposing sides of the drawbar 48; two pairs of inner and outer bell cranks (only one pair of which is shown at 60 and 62 in FIG. 3) pivotally attached to the drawbar links 58 on opposing sides of the drawbar 48, which cause triggering loads to change direction about their pivot pins; and a pair of intermediate links (only one of which is shown at 64 in FIG. 3) on opposing sides of the drawbar 48, which span between each pair of bell cranks (such as 60 and 62) and transmit triggering loads between the turnbuckles to locations along opposing sides of the conveyance. A pair of trigger paddle links 66 and 68 are attached to the outermost (or end) opposing bell cranks (such as 62), which become raised in an upward direction upon activation and further carry the triggering loads, as described in greater detail below.

At the moment of any severance within the conveyance suspension system, or a slack rope condition in the case of a downward traveling conveyance, the drawbar 48 is no longer pulled in an upward direction by the hoisting cable (wire rope), causing the drawbar 48 to be forced downwardly by the trigger springs 54 and 56 from their previously-compressed condition into a relaxed, uncompressed, condition. The extension of the trigger springs 54 and 56 releases their previously-stored energy to activate the safety brake activation response built into the trigger linkage system 46, which includes rotating the inner most bell cranks (such as at 60) toward the drawbar 48, which moves the intermediate links (such as at 64) toward the drawbar, which rotates the outermost (or end) bell cranks (such as at 62) toward the drawbar 48, which in turn raises the trigger paddle links 66 and 68 in an upward direction parallel to the sides of the conveyance. It will be appreciated that this activation response occurs substantially identically and simultaneously along both sides of the safety brake 40 and 42 disposed on opposite sides of the conveyance, upon the extension of the trigger springs 54 and 56.

As shown in FIGS. 3 through 7, the safety brake comprises five primary components, which are provided in two substantially identical sets (shown at 40 and 42 in FIG. 3) along opposing sides of the conveyance. The first component is a pair of guide clamp trigger assemblies, which activate the safety brake upon detection of a conveyance suspension failure or slack rope condition. Slack rope is a condition where the hoisting wire rope is still intact and connected to the draw bar of the conveyance; however, the conveyance has become suspended in the mine shaft by some unintentional obstruction. This can typically only happen when the conveyance is travelling downward in the mine shaft and becomes obstructed, causing the rope end load to diminish or become zero as a result of the conveyance now being suspended by some unintentional means. The second component is a pair of guide clamp assemblies, mechanisms which operate to substantially self-lock onto the mine shaft mounted guides under conveyance suspension failure or slack rope conditions. The third component is two pairs of brake caliper assemblies, moving brake elements which are linked to the guide clamp assemblies and operate to generate braking forces in a controlled manner. The fourth component is two pairs of brake paths, stationary tapered brake elements attached in pairs to each side of the conveyance, with which the brake caliper assemblies interact. Finally, the fifth element is a group of brake end stop buffers which act to dampen arresting forces should the brake calipers reach the end of possible travel during a safety brake event. The brake end stop buffers provide redundancy to the system such that brake caliper or brake path faults will not prevent the arrestment of the conveyance. Each of these components is described in more detail below.

The guide clamp trigger assemblies comprise a pair of trigger paddles 74 and 76 (one for each guide clamp trigger assembly) that are attached to the trigger paddle links 66 and 68 and are disposed along opposing sides of the conveyance. The trigger paddles 74 and 76 are actuated from a restrained, or standby, condition through their connection to the trigger assembly linkages 66 and 68. The trigger paddles are specially configured to either restrain or activate the guide clamp assemblies in part to prevent unintentional safety brake activation. Two pairs of clamp retaining pins 78, 80, 82 and 84 (one pair for each guide clamp trigger assembly) that are removable to allow for easy resetting of the safety brake system are included. The clamp retaining pins 78, 80, 82 and 84, engage the trigger paddles 74 and 76 with the guide clamp assemblies until a detachment of the conveyance or slack rope condition occurs. When the trigger paddles move upward the guide clamp assemblies also move upward with them but simultaneously move inward toward the shaft guides 14 and 16. As they move inwardly toward the shaft guides the guide clamp assemblies escape the retaining pins 78, 80, 82 and 84, allowing them to engage and self-lock onto the shaft guides. This is the case for conveyance suspension failure and slack rope conditions alike. A slack rope condition initiates safety brake activation in the same way a suspension failure does.

The guide clamp assemblies comprise two pairs of clamp wedges (one pair for each assembly), three of which are visible in FIG. 3 at 86, 88 and 90, with only items 86 and 88 shown in FIGS. 4 through 7. The clamp wedges have a tapered profile and as such, are configured to travel upwardly and inwardly upon activation. Attached upon the clamp wedges 86 and 88 (not visible upon the clamp wedge 90 in FIG. 3) are clamp shoes 92 and 94 having toothed surface profiles that are operable for engaging the guides 14 and 16. The guide clamp assemblies also include two pairs of clamp slides 96, 98, 100 and 102 (one pair for each guide clamp assembly) that engage and guide the clamp wedges and thereby connect the guide clamp assemblies with the brake caliper assemblies. The clamp wedges, such as those visible at 86 and 88, also include grease fittings 104 and 106 that allow for lubrication and corrosion protection of the slide mechanism between the clamp wedges and the clamp slides. The guide clamp assemblies also include clamp enforcement springs, shown only in the exploded view in FIG. 6 at 108, disposed to provide force between each clamp wedge and each clamp slide to provide continuous engagement of each clamp shoe (such as at 92 and 94) with the guides 14 and 16 during a safety brake event.

The guide clamp assemblies also include a pair of main tie plates 110 and 112 to which the clamp slides 96, 98, 100 and 102 are affixed in pairs to create rigid guide clamp structures that engage the guides 14 and 16 from opposing sides upon activation. In addition, as shown in FIGS. 4 through 7, the clamp slides 96 and 98 (also present but not visible in connection with clamp slides 100 and 102) each include an upper travel stop 114 and 116 and a lower travel stop 118 and 120. The upper travel stops 114 and 116 prevent the clamp wedges 86 and 88 from traveling in an upward direction beyond the range of the clamp slides 96 and 98 (as they also do for the clamp slides 100 and 102, though not visible in the drawings), while the lower travel stops 118 and 120 support the clamp enforcement springs (such as at 108) and also prevent the clamp wedges from traveling in a downward direction beyond the range of the clamp slides 96 and 98 (as they also do for the clamp slides 100 and 102, though not visible in the drawings).

Each brake caliper assembly is comprised of a brake caliper inner casing, shown at 122, 124, 126 and 128 in FIG. 3, with only items 122 and 124 visible in FIGS. 4 through 7. The brake caliper inner casing serves to connect the brake caliper assembly to the clamp slides 96, 98, 100 and 102. Pins are disposed at 130, 132, 134, 136, 138, 140, 142 and 144 in FIG. 3 (with only pins 130, 132, 134 and 136 shown in FIGS. 4 through 7) in upper and lower locations connecting the brake caliper inner casings and the clamp slides to provide a loose connection between those components, as well as a means to locate the clamping action of the safety brake.

Figure 6:
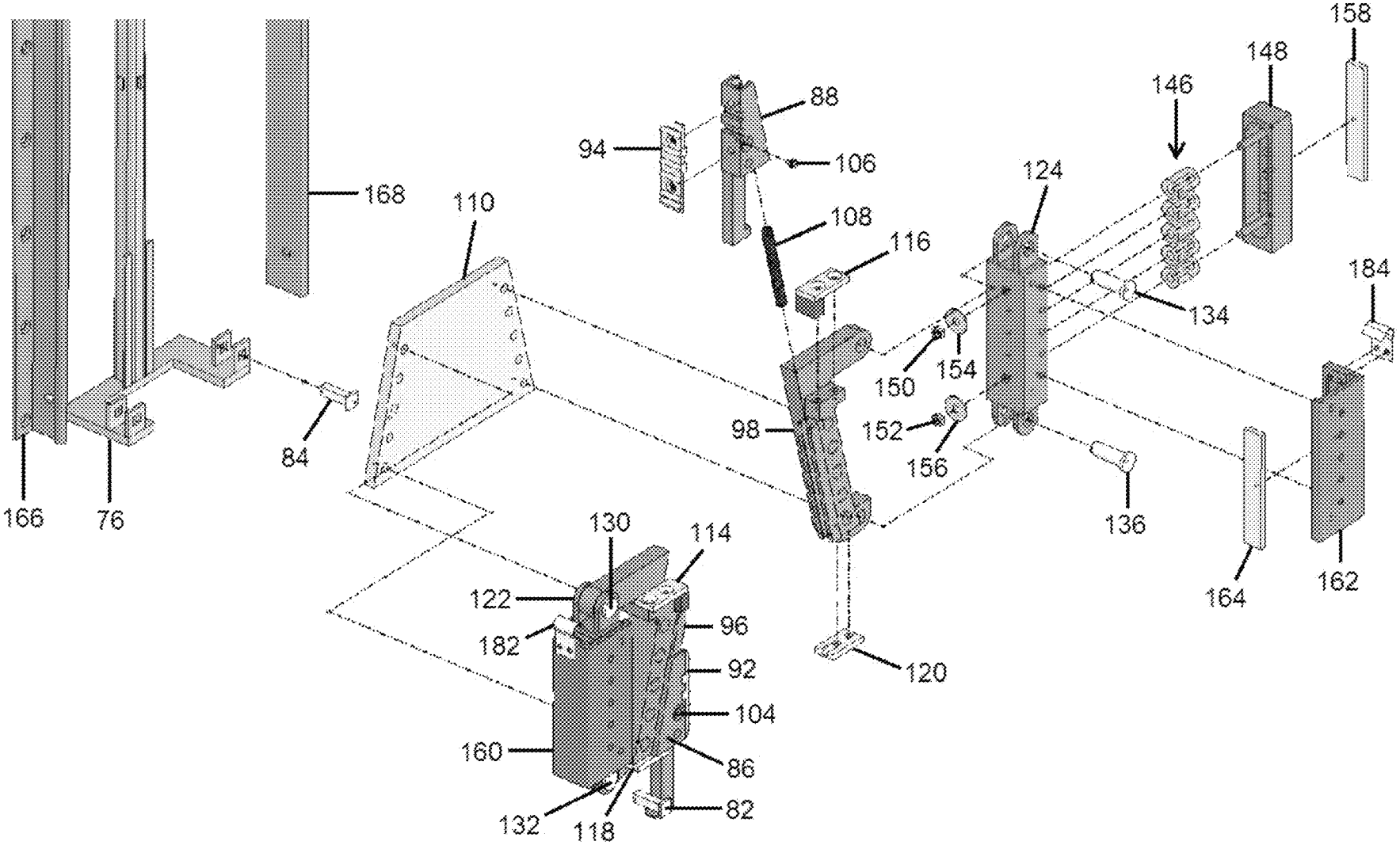
FIG. 6 is a partially exploded view showing a guide clamp trigger assembly, a guide clamp assembly, brake caliper assemblies and brake paths, comprising one side of the safety brake of the present invention.
Figure 7:
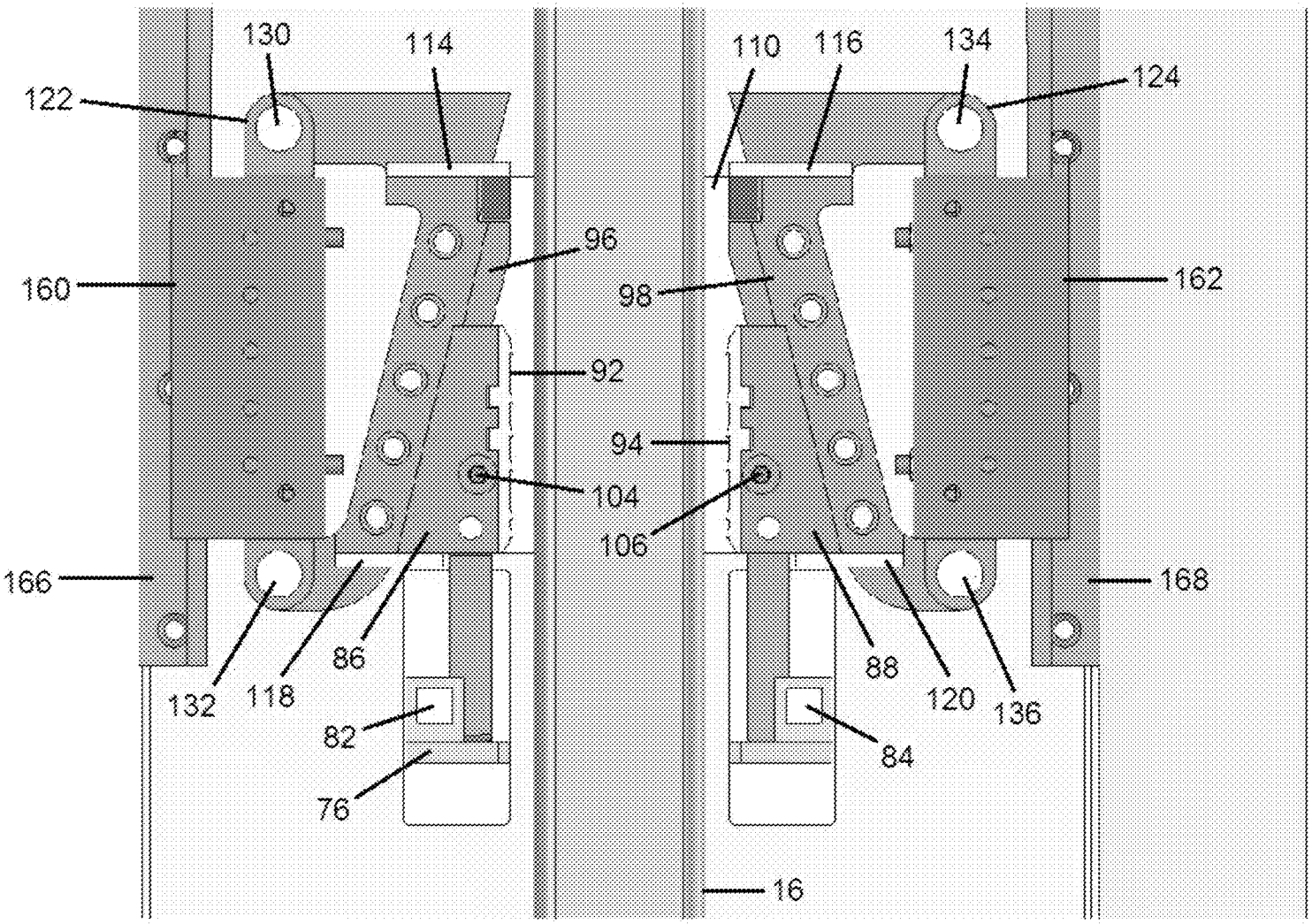
FIG. 7 is a side view showing a guide clamp trigger assembly, a guide clamp assembly, brake caliper assemblies and brake paths, comprising one side of the safety brake of the present invention, in relative position to a conveyance and a mine shaft guide.

The brake caliper assemblies also each include a plurality of brake compression springs, shown at 146 in FIG. 6 (and also present but not visible in the other assembly drawings), that are disposed within the brake caliper inner casings 122, 124, 126 and 128. The brake compression springs provide force for the brake caliper assemblies in opposed outward directions so that the brake caliper assemblies can perform their braking functions. The brake compression springs of the type shown at 146 are held in place within the brake caliper inner casings by brake caliper spring housings, shown at 148 in FIG. 6 (and also present but not visible in the other assembly drawings). Upper and lower caliper retraction nuts 150 and 152, along with washers 154 and 156 (again, also present but not visible in the other assembly drawings), secure the brake caliper inner casings to the brake caliper spring housings, while the washers 154 and 156 provide a bearing surface between the caliper retraction nuts and the brake caliper inner casings. Inner brake pads, such as that shown at 158 in FIG. 6, are friction elements affixed to an exterior surface of each brake caliper spring housing 148, to deliver a first direction of frictional braking force resulting from the compression force delivered by the brake compression springs 146 against the brake path via the brake caliper spring housing, as explained further below.

The brake caliper assemblies also each include a brake caliper outer casing, three of which are visible in FIGS. 2 and 3 at 160, 162 and 163, with only items 160 and 162 shown in FIGS. 4 through 7. As shown best in FIG. 6 at 162, the brake caliper outer casings are each fixedly attached to the brake caliper inner casings 122, 124, 126 and 128. Affixed to an interior surface of each brake caliper outer casing is an outer brake pad, each of which is also a friction element, such as that shown at 164 in FIG. 6, that delivers a second direction of frictional braking force resulting from the compression force delivered by the brake caliper springs 146, for each of the brake calipers, also as explained further below.

Figure 4:
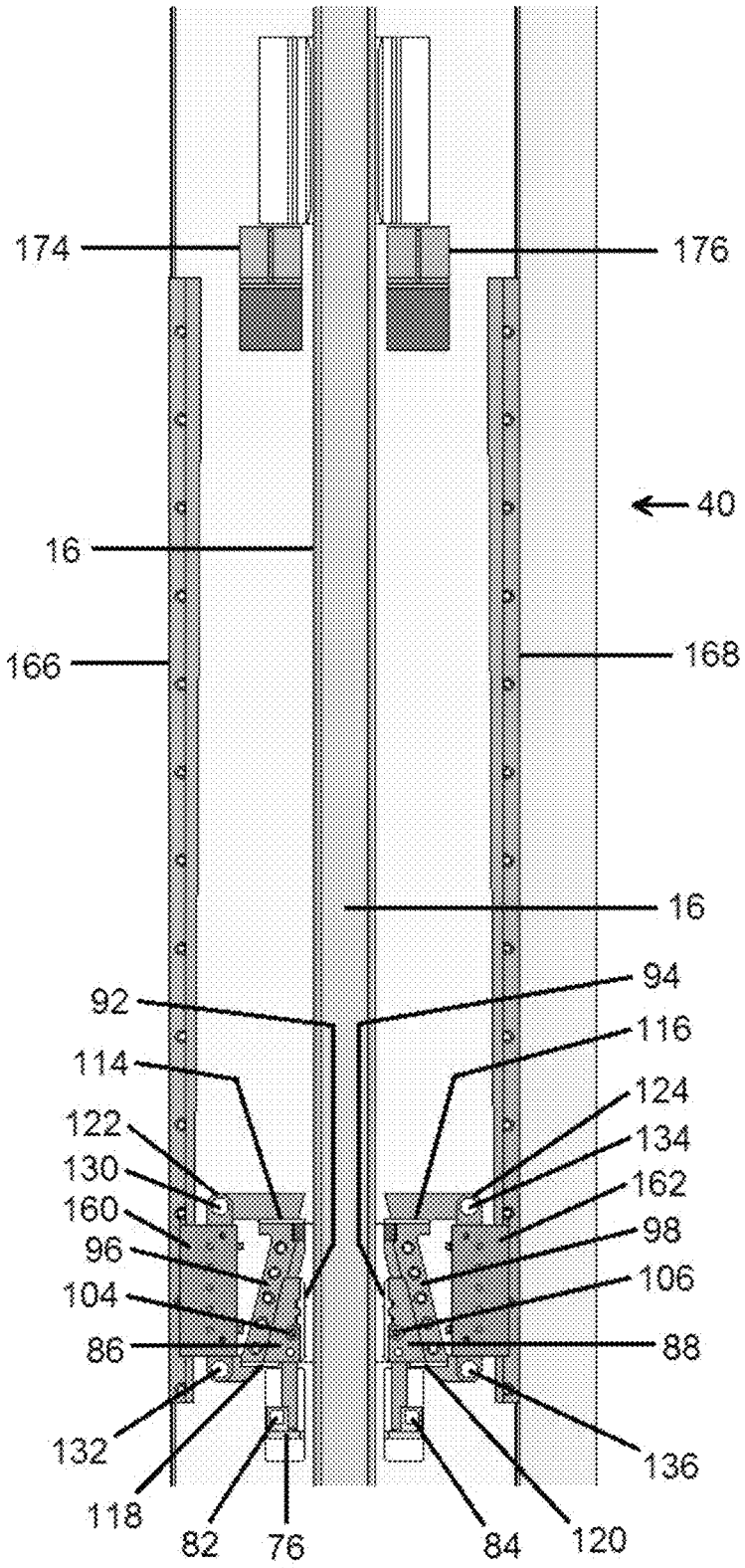
FIG. 4 is a side view of a safety brake according to the present invention.
Figure 5:
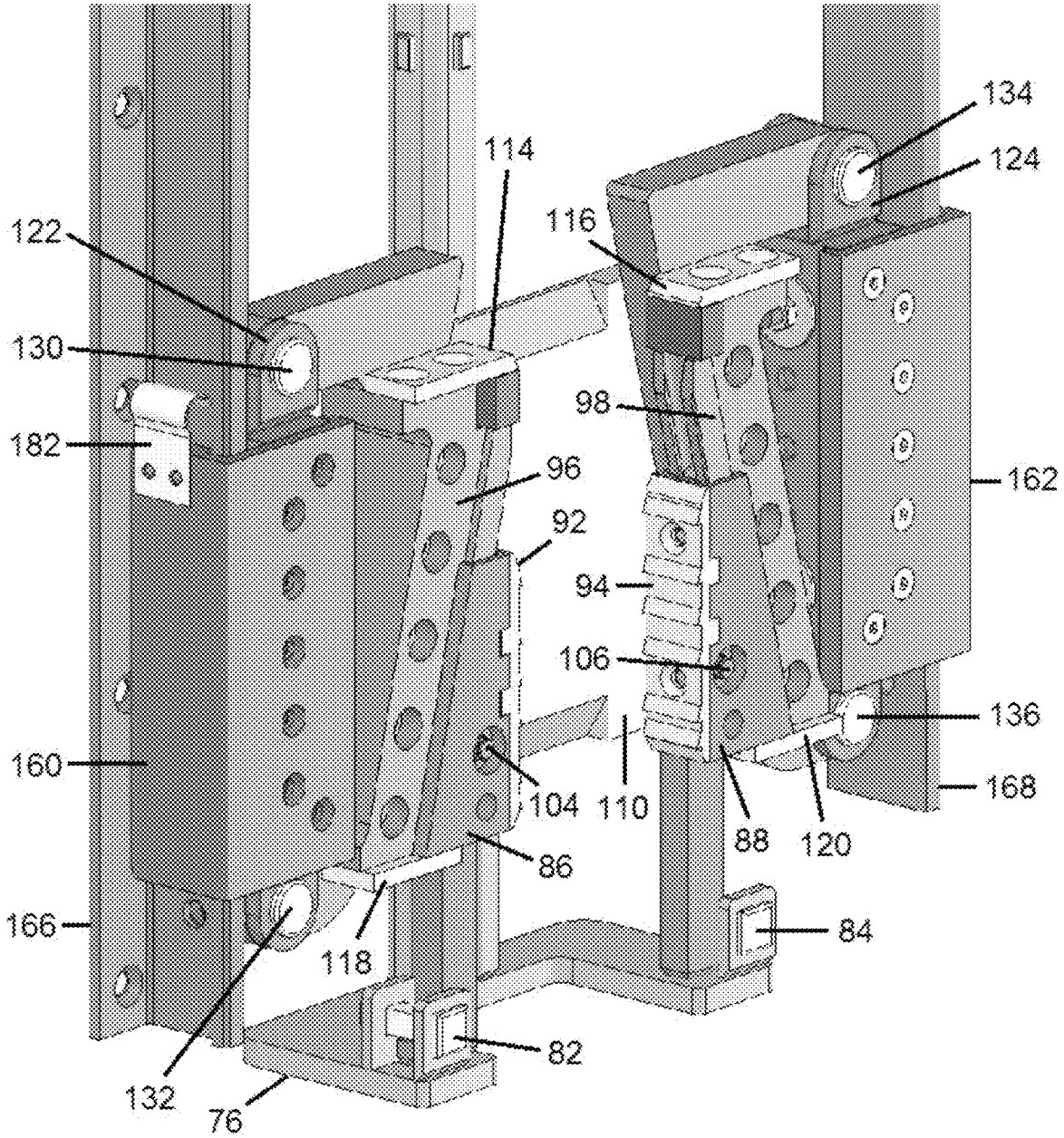
FIG. 5 is a perspective view showing a guide clamp trigger assembly, a guide clamp assembly, a pair of brake caliper assemblies and brake paths, comprising one side of the safety brake of the present invention.

The safety brake also comprises two pairs of brake paths, shown at 166, 168, 170 and 172, which are stationary tapered linear brake elements attached in pairs to each side of the conveyance in a configuration substantially parallel to the conveyance's direction of travel along the guides 14 and 16, which may often be in a substantially vertical configuration, depending upon the inclination of the mine shaft. As best seen in FIG. 4, the brake paths are engineered to have tapered configurations with wider profiles at their tops and narrower profiles at their bottoms, with the degree(s) and/or range(s) of tapering able to be varied as necessary based on the design requirements of each application. During normal operation of the conveyance when the safety brake is not in use, the brake caliper assemblies are held in a stationary position by the engagement of the clamp retaining pins 78, 80, 82 and 84 with the trigger paddles 74 and 76 adjacent the narrow bottom ends of the brake paths, which represent the normal, or rest, positions for the brake caliper assemblies. It will be appreciated that the lengths, thicknesses and degrees of profile tapering for the brake paths can be adjusted as needed to provide the desired braking characteristics for the safety brake device as a whole.

The brake paths 166, 168, 170 and 172 are mounted upon the sides of the conveyance so that the inner brake pads, such as at 158, engage the inner surfaces of the brake paths (facing toward the other brake path attached upon the same side of the conveyance), while the outer brake pads 164 engage the outer surfaces of the brake paths (facing away from the other brake path attached upon the same side of the conveyance). In this arrangement, the brake caliper assemblies are forcibly applying a brake pad, such as 164, in a fixed manner upon the outer surface of the tapered brake path 168. This brake pad 164 is located on the opposite (outer) side of the tapered brake path 168 from the (inner) side of the tapered brake path 168 upon which the brake caliper spring housing 148 forcibly applies its brake pad 158 against the brake path. Accordingly, the brake caliper assemblies are transferring vertical clamp forces from the guide clamp assemblies, specifically, the clamp shoes 92 and 94 to the brake paths.

Attached to the conveyance are four safety devices referred to as brake stop buffers (one pair on each side of the conveyance) designed to absorb excess system energy in the event of brake caliper over travel upon the brake paths. A plurality of shear bolts (not shown) are attached upon the brake paths at their upper ends by being inserted within the sets of three apertures 186, 188, 190 and 192 in FIG. 3, although it will be appreciated that any suitable of shear bolts may be used, within any suitable number of apertures disposed upon the brake paths. These shear bolts are sheared off by the brake caliper assemblies in the event of brake over travel, assisting in stopping downward travel of the conveyance. The brake stop buffers, attached to the conveyance near the upper end of the brake paths 166, 168, 170 and 172, are made from a suitable cushioning material, four of which are shown at 174, 176, 178 and 180 in FIG. 3. In the event of brake caliper assembly over travel all the way to the top of the brake paths, the top face of the clamp slides 96, 98, 100 and 102 are able to contact and compress the brake end stop buffers to further absorb excess system energy, further assisting in stopping downward travel of the conveyance. It is noted that under a safety brake event the invention is designed to stop the conveyance prior to reaching a brake caliper over travel condition thereby making the noted shear bolts and brake end stop buffers a redundant means of stopping the conveyance.

As an additional feature, the brake caliper assemblies will also each include a brake path scraper, two of which are shown at 182 and 184 in FIGS. 3 and 6, which clean the clamping surfaces of the tapered brake paths 166, 168, 170 and 172 of contamination.

Should a conveyance 10 no longer be properly suspended by its hoisting cable (wire rope) 12, by any failure of the types described above, it will immediately begin to free fall down the mine shaft under full gravitational pull and the following sequence of events will occur immediately thereafter. The lack of upward force exerted by the hoisting cable (wire rope) 12 in particular, upon the drawbar 48 and its aperture 50 upon which the hoisting cable (wire rope) 12 is attached, allows the drawbar 48 and its attached cross plate 52 to be forced in a downward direction by the release of the trigger springs 54 and 56 from their previously-compressed condition into a relaxed, uncompressed, condition. As a result, the triggering loads released from the trigger springs 54 and 56 become transferred through the trigger mechanism 46 to the trigger paddles 74 and 76, as follows. The downward travel of the drawbar 48 and its attached cross plate 52 causes the pair of drawbar links (one shown at 58) on opposing sides of the drawbar 48 to be pulled in a downward direction, which rotates the inner bell cranks (one shown at 60) toward the drawbar 48, which in turn pull the pair of intermediate links (one shown at 64) inwardly toward the drawbar 48. This, in turn rotates the outer bell cranks (one shown at 62) inwardly toward the drawbar 48, which in turn pull the trigger paddle links 66 and 68 upwardly, which in turn pull the trigger paddles 74 and 76 upwardly parallel to the sides of the conveyance, thereby activating the guide clamp trigger assemblies of the safety brake 40 and 42.

The upward motion of the trigger paddles 74 and 76 pushes the clamp wedges (such as at 86, 88 and 90) upwardly and inwardly toward the shaft guides 14 and 16, thereby releasing them from the clamp retaining pins 78, 80, 82 and 84, subsequently activating the guide clamp assemblies. Once released, the clamp wedges, through their attached clamp shoes 92 and 94, substantially lock onto the guides 14 and 16, causing a self-energizing effect whereby the energy of the falling conveyance 10 is directly transferred from the guide clamp assemblies to the brake caliper assemblies. Accordingly, as the conveyance continues to descend, the brake caliper assemblies, including the opposing brake pads 158 and 164, which are mechanically held captive to the engineered brake paths 166, 168, 170 and 172, are pushed upwardly along the tapered brake paths as a result of the substantially locked engagement of the guide clamp assemblies against the guides 14 and 16. As the brake caliper assemblies translate upwardly upon the widening brake paths, the brake pads 158 and 164 are forced into frictional contact with the brake paths 166, 168, 170 and 172 and encounter wider and wider brake path profiles during their upward travel which serves to proportionately increase the brake caliper clamping force between the brake path and brake pads. The widened brake path profiles encountered by the upwardly moving brake caliper assemblies increase the applied braking force in a controlled manner by compressing the brake springs 146. The increased clamping force in turn increases the braking or arresting force between the brake pads and the brake paths in a controlled manner until all of the kinetic energy of the falling conveyance is absorbed by all of the involved elements to various degrees, including shaft guides, brake calipers, brake paths and the structural parts of the conveyance, causing the conveyance to come to a complete stop. Once the conveyance has stopped, the safety brake holds it in position with no further fall possible.

In the event that the above activities cannot bring the conveyance to a complete stop by the time the brake caliper assemblies over travel upwardly all the way to the tops of the brake paths 166, 168, 170 and 172, the brake caliper assemblies will encounter the shear bolts, a safety feature attached upon the brake paths at their upper ends which can be sheared off by the brake caliper assemblies to absorb excess energy. As an additional safety feature in the event of brake caliper assembly over travel, the top face of the clamp slides 96, 98, 100 and 102 contact and compress the brake end stop buffers 174, 176, 178 and 180, absorbing excess system energy and further assisting in stopping downward travel of the conveyance. The brake stop end buffers provide an ultimate end stop and add redundancy to the brake system.

To reset the device after a safety brake event, the caliper retraction nuts 150 and 152 are used to retract the brake caliper spring housings of the type shown at 148 into the brake caliper inner casings 122, 124, 126 and 128 to disengage the brake pads, such as 158 and 164, from the tapered brake paths 166, 168, 170 and 172.

The safety brake mechanism is unidirectional. During normal conveyance travel the guide clamp system is free from contact with the guides 14 and 16 and is positioned beyond the faces of the slippers 36, 38 (and others not shown in FIG. 2), preventing inadvertent engagement with the guides 14 and 16. Because of the wedge-shaped design of the clamping components, the guide clamp system can only engage when the conveyance 10 is traveling in a downward direction. Accordingly, it is mechanically impossible for the guide clamp system to engage during hoisting (upward travel of the conveyance 10) as this direction of travel would force the clamps to an open, rather than a closed, condition.

The safety brake of the present invention is a robust, scalable, purely mechanical design with acceptable component wear that operates without hydraulic or electronic controls, which is preferred for a mine shaft environment. The guide clamp assemblies reliably self-lock onto steel guides and are intended to also be adapted for use with timber guides, where the condition of such guides permits. The brake caliper and engineered tapered brake path design generates manageable and adjustable braking forces in appropriate and useful magnitudes, which provides low "jerk" rates and therefore reduces the likelihood of injury to conveyance occupants and damage to conveyance cargo during an emergency braking event. The present safety brake rate of deceleration characteristics are also less sensitive to the conveyance's payload during an emergency braking event since energy is transferred into the safety brake at an ever-increasing rate. In addition, the present safety brake incorporates shear bolts and brake end stop buffers at end-of-travel to absorb system energy in the event of brake over travel. The present safety brake is expected to comply with relevant regulations governing mine safety, and can be adjusted and adapted for complying with future regulations as required. The present safety brake is also intended to be used with new conveyances or retrofitted when conveyance construction and in mine shaft conditions are appropriate with adjustments and adaptation as necessary in the upgrade of existing conveyances.

It will be understood that the present invention may be utilized in any suitable mine shaft environment having either a vertical, substantially vertical or inclined configuration, that is, where a conveyance travels in directions having a substantial vertical component that could cause rapid downward travel (even if not completely vertical) in the event of a detached conveyance event.

The safety brake system is engineered, sized and tuned for each application and calibration is achieved through brake caliper spring selection and brake path geometry. In this way, the safety brake can be calibrated to perform according to desired characteristics and according to each specific conveyance application, and regulate braking force in a desirable way. This is a safety enhancement that is presently not available with "safety dog" type systems. The friction surfaces upon which the emergency stopping dynamics depend are also much better controlled in the present invention, leading to increased reliability and predictability. The present safety brake has also been engineered to prevent inadvertent engagement that would result in arrestment of the conveyance while the conveyance is suspended from the hoisting cable (wire rope).

In addition, a mechanical failure of any component of the safety brake of the present invention will not cause the guide clamping mechanism to engage the guides because guide clamp engagement is initiated from a separate triggering source. The guide clamping mechanism is truly a unidirectional device capable of clamping in only the downward direction of travel which in itself halves the possibility of inadvertent clamp engagement. There are a minimum of four caliper and brake path assemblies per conveyance. Each of the brake paths includes a mechanical brake stop shear bolt arrangement and buffer at the end of travel should there be a loss of friction for any reason. When four brake calipers are used there are eight friction elements per conveyance. Each brake caliper is guided and contained in place within channels integral to the brake path assemblies.

While this subject matter has been disclosed with reference to specific embodiments, it is apparent that other embodiments and variations can be devised by others skilled in the art without departing from the true spirit and scope of the subject matter described herein. The appended claims include all such embodiments and equivalent variations.

The invention claimed is:

1. A safety brake for controlling the rate of deceleration of a free-falling conveyance operating upon shaft guides fixed within a mine shaft having a substantial vertical component, said safety brake comprising:

an activation system operable for supporting the conveyance during normal travel of the conveyance upon the shaft guides and storing activation energy while supporting the conveyance, said activation system further operable for detecting a conveyance suspension failure or slack rope condition associated with a free-falling or obstructed condition of the conveyance, and said activation system further operable for releasing said activation energy upon detecting said conveyance suspension failure or slack rope condition to activate said safety brake;

at least one guide clamp assembly comprising a pair of clamp wedges and a pair of clamp slides, the clamp wedges having an upwardly-narrowing tapered shape and being movingly engaging with the clamp slides, said guide clamp assembly disposed in communication with said activation system and, upon activation by the activation system, the clamp wedges are operable to substantially self-lock onto a shaft guide upon both of the clamp wedges simultaneously travelling upwardly and inwardly and towards each other along the clamp slides;

at least one linear brake element fixedly attached upon the conveyance and arranged substantially parallel to the conveyance's direction of travel along the shaft guides; and at least one braking assembly disposed in communication with said at least one guide clamp assembly and disposed for traveling engagement with said at least one linear brake element, the at least one braking assembly comprising an inner brake pad and an outer brake pad arranged on opposite sides of the at least one linear brake element, said inner brake pad being configured to engage an inner surface of the at least one linear brake element and said outer brake pad configured to engage an outer surface of the at least one linear brake element;

wherein said release of said activation energy by said activation system causes said at least one guide clamp assembly to be released from a standby condition and to substantially self-lock onto a shaft guide, causing said at least one braking assembly to travel upwardly upon said at least one linear brake element as the conveyance falls downwardly, said upward travel of said at least one braking assembly upon said at least one linear brake element being operable for generating increasing braking forces by said at least one braking assembly upon said at least one linear brake element in a controlled manner, thereby bringing the conveyance to a stop.

2. The safety brake according to claim 1 further comprising at least one brake end stop buffer attached upon the conveyance adjacent to an upper end of said at least one linear brake element for engagement by said at least one braking assembly at an end of its upward travel upon said at least one linear brake element, said engagement between said braking assembly and said at least one brake end stop buffer being designed to absorb excess system energy in the event of braking assembly over travel upon the at least one linear brake element, assisting in stopping downward travel of the conveyance.

3. The safety brake according to claim 1 comprising a pair of guide clamp assemblies disposed in communication with said activation system on opposing sides of the conveyance, each guide clamp assembly being operable, upon activation by the activation system, to substantially self-lock onto a different shaft guide among a pair of shaft guides located on opposing sides of the conveyance.

4. The safety brake according to claim 1 comprising:

a pair of linear brake elements fixedly attached upon the conveyance;

a guide clamp assembly disposed in communication with said activation system and operable to substantially self-lock onto a shaft guide upon activation by the activation system; and a pair of braking assemblies disposed in communication with a guide clamp assembly, each braking assembly disposed for traveling engagement with a different linear brake element.

5. The safety brake according to claim 1 comprising:

two pairs of linear brake elements, each pair fixedly attached upon opposing sides of the conveyance;

a pair of guide clamp assemblies disposed in communication with said activation system on opposing sides of the conveyance, each guide clamp assembly being operable to substantially self-lock onto a different shaft guide among a pair of shaft guides located on opposing sides of the conveyance upon activation by the activation system; and two pairs of braking assemblies, each pair of braking assemblies disposed in communication with a guide clamp assembly on opposing sides of the conveyance, each braking assembly disposed for traveling engagement with a different linear brake element.

6. The safety brake according to claim 1, wherein each of said at least one linear brake elements is attached to the conveyance in a configuration substantially parallel to the conveyance's direction of travel along the shaft guides, and wherein each of said at least one linear brake elements is a tapered linear brake element having a narrow lower profile and a wider upper profile, such that upward travel of each braking assembly upon each brake path as the conveyance falls downwardly brings each braking assembly in increasingly forceful braking engagement with each of said at least one linear brake elements for generating increasing braking forces by each braking assembly upon each at least one linear brake element in a controlled manner.

7. The safety brake according to claim 1, wherein said activation system includes at least one trigger paddle disposed in communication with said at least one guide clamp assembly, and wherein said release of said activation energy by said activation system is operable for actuating each said trigger paddle to release each said guide clamp assembly from a standby condition, thereby allowing each said guide clamp assembly to engage, and substantially self-lock upon, a shaft guide.

8. A method of controlling the rate of deceleration of a free-falling conveyance comprising the safety brake of claim 1 operating upon shaft guides fixed within a mine shaft having a substantial vertical component, the method comprising the steps of:

activating an activation system upon detection of a conveyance suspension failure or slack rope condition resulting in free-falling conveyance;

locking at least one guide clamp assembly into place onto a shaft guide by moving a pair of clamp wedges simultaneously upwardly and inwardly and towards each other along a pair of clamp slides, to substantially vertically fix the guide clamp assembly while the conveyance continues to free-fall;

braking the conveyance by generating braking force between a linear brake element fixedly attached upon the conveyance and moving downwards with the conveyance and at least one braking assembly disposed in communication with said at least one guide clamp assembly and being fixed in place.

* * * * *